US005331699A

United States Patent [19]

Patton et al.

[11] Patent Number: 5,331,699

[45] Date of Patent: Jul. 26, 1994

[54] INFANT SLEEP SUPPORT

[76] Inventors: Jeffrey M. Patton, 8943 Nottingham Dr., Ypsilanti, Mich. 48198; Charles N. Inniss, 6001 W. Outer Dr., Ste. 420, Detroit, Mich. 48235

[21] Appl. No.: 120,405

[22] Filed: Sep. 13, 1993

[51] Int. Cl.[5] ..... A47G 9/06; A47D 15/00

[52] U.S. Cl. ..... 5/655; 5/490; 5/922; 128/876

[58] Field of Search ..... 5/655, 632, 630, 490, 5/424, 922, 923; 128/869-876

[56] References Cited

U.S. PATENT DOCUMENTS

| | | | |
|---|---|---|---|
| 2,404,505 | 7/1946 | Knecht | 5/655 |
| 3,034,502 | 5/1962 | Lund | 5/632 |
| 3,924,282 | 12/1975 | Bond | 5/632 |
| 4,188,678 | 2/1980 | Rawolle | 5/655 |
| 4,214,326 | 7/1980 | Spann | 5/632 |
| 4,574,412 | 3/1986 | Smith | 5/490 |
| 4,924,543 | 5/1990 | Hoss et al. | 5/490 |
| 5,165,130 | 11/1992 | Wendling | 5/655 |
| 5,189,748 | 3/1993 | Garrison et al. | 5/655 |
| 5,193,238 | 3/1993 | Clute | 5/655 |

FOREIGN PATENT DOCUMENTS

| | | | |
|---|---|---|---|
| 1449012 | 7/1966 | France | 5/655 |

*Primary Examiner*—Alexander Grosz
*Attorney, Agent, or Firm*—Dykema Gossett

[57] ABSTRACT

An infant sleep support supports a sleeping infant at its back and holds the infant so that the infant will sleep on its side. The sleep support has a fabric sheet on which the infant sleeps and a pillow against which the infant supports its back. An abdominal brace attached to the sheet and pillow holds the infant against the pillow so that the infant is on its side.

8 Claims, 2 Drawing Sheets

INFANT SLEEP SUPPORT

BACKGROUND OF THE INVENTION

1. Field of the Invention

The present invention relates to devices for restraining a sleeping infant to keep the infant on its side and to prevent the infant from falling off its sleep platform.

2. General Background

In the Tuesday, Aug. 10, 1993, issue of the New York Times, page B6, an article on studies concerning Sudden Infant Death Syndrome, reports mounting evidence indicating that babies who sleep face down are at a greater risk than those who sleep on their backs and sides. One study reported in the article, conducted by the Menzies Center for Population Health Research at the University of Tasmania, supports an earlier study published by the American Pediatric Association in May of 1992 in finding that infants who slept on their sides were at less of a risk of dying from Sudden Infant Death Syndrome than infants who slept on their stomachs. The article alludes to the concerns of some pediatricians, however, about infants sleeping on their backs and risking inhalation of stomach fluids. Earlier studies and insights into these phenomena have resulted in a number of devices for controlling sleeping posture, some of which are particularly adapted to overcome risks of Sudden Infant Death Syndrome.

3. Prior Art

U.S. Pat. No. 5,189,748 issued to Garrison et al. on Mar. 2, 1993, discloses a device to keep an infant on its side while sleeping and thus avoid Sudden Infant Death Syndrome. The infant side support has a back support and abdominal support attached to a mat on which the infant is laid on its side between the two supports. The infant is kept in a stationary position as a result of the structure, to avoid turning on its back or its stomach. The device has one apparent shortcoming, in that it does not keep an infant who is smaller than the distance between the back support and the abdominal support from twisting onto its back or into a face down position.

U.S. Pat. No. 5,193,238, issued to Clute on Mar. 16, 1993, discloses a support pillow with two detachable main sections, each having an elongated right triangle wedge shaped from a resilient foam member covered with fabric. The two detachable main sections may be spaced apart from one another, with a VELCRO TM brand fastening means attached to each section so that they are in a set spaced relationship. The infant is placed between the two wedges. A strap may be attached across the top of the wedge shaped pillows to stationarily support the pillows. This device also has an apparent shortcoming in that it is particularly confining to the infant, pinning its arms between the two wedges while the infant is sleeping.

Other devices have been disclosed which might be used for the purpose of supporting an infant on its side, or at least avoiding its sleeping in a prone position, though not particularly designed for that purpose. U.S. Pat. No. 3,034,802 issued to Lund on May 15, 1962, discloses an infant holder for restraining the movement of a small child, although it was not designed for keeping the child on its side or back during sleeping. The Lund device was designed for restraining a child during certain operative procedures and medical administrations to avoid injuring the child. It shortcoming it that it is not a comfortable device for the child to sleep in and that it restrains the child to lie on his or her back.

U.S. Pat. No. 4,214,326 issued to Spann on Jul. 29, 1980, discloses an apparatus for positioning and protecting a patient in a bed. The apparatus has protective cushioning for a side frame of the bed. The protective cushioning is substantially cylindrical, except for a flat surface. The device could be downsized for an infant. It is not, however, adapted to keep the infant from rolling in both directions, as a back device would restrain the infant from rolling on its back but the front device is only to protect the infant from injuring itself on the crib restraining rail.

U.S. Pat. No. 3,924,282 issued to Bond on Dec. 9, 1975, discloses a therapeutic prop-like support for maintaining a sleeping or otherwise reclining person on his or her side. Again, the device is not particularly designed for an infant. Its structure would restrain an infant in the manner of the device disclosed by Clute, if the Bond device were downsized.

U.S. Pat. No. 4,574,412 issued to Smith on Mar. 11, 1986, discloses an L-shaped anchored pillow. The Smith device uses a mat having a VELCRO TM brand strip to which the pillow support may be easily attached to keep it stationary with respect to the mat. This device, too, might be downsized for an infant but would not restrain the infant from rolling on its face if the pillow were situated at the back of the infant.

Besides the particular shortcomings discussed in connection with each of the above presented prior art, all of the above prior art suffers from not providing a combination of a frontal support to prevent the child from rolling onto its stomach, adjustability for different sized infants, portability and washability and a means for keeping the infant or a small child from rolling off its sleep platform, while not unnecessarily confining the infant or child during its sleep. Therefore, there is a need for a suitable structured infant sleep support to reduce the occurrence of Sudden Infant Death Syndrome with other advantages conceived of by the inventors of the infant sleep support.

SUMMARY OF THE INVENTION

According to the present invention, an infant sleep support has a planar terry cloth sheet base on which an infant may be placed on its side so that the infant rests on the sheet base. The infant sleep support also has a cylindrical pillow against which the infant may rest its back. The planar sheet base extends from the front of the cylindrical pillow, and a sheet flap extends from the back of the pillow, underneath of the pillow in the direction of the sheet base.

The pillow includes a pillow cover to which the sheet base and the sheet flap are attached, all of which are made of the same material, preferably a soft terry cloth. The pillow cover and pillow are constructed in a shape that is substantially cylindrical as it extends around its axis from the front, which faces the infant, to the back, and there, extends downwardly, as the pillow is generally orientated in use, to a planar back that is tangent to the cylindrical shape. Beneath the sheet base are fasteners that cooperate with complementary fasteners disposed on the top side of the sheet flap, relative to the orientation of the infant sleep support when in use. These fasteners are attached to one another so that the sheet flap fixedly closes an opening to the interior of the pillow cover, enclosing a pillow bolster therein. The pillow bolster, which is placed in the interior of pillow cover to form the pillow, is constructed to be soft, yet supporting. It has an outer surface, preferably of vinyl or some other material impermeable to liquids.

Another embodiment of the invention has a sheet base and sheet flap that can be tucked under a mattress. Yet another embodiment of the infant sleep support has an additional element of a abdominal brace attached to the joinder of the pillow cover and the sheet base. With this latter embodiment, a diaper strap is attached to the cylindrical front surface of the pillow cover. The abdominal brace and the diaper strap both have free ends with fasteners attached thereto. When an infant is placed upon the sheet base and the abdominal brace, the diaper strap is threaded between the legs of the infant and its fastener is attached to one of the fasteners on the abdominal brace. The infant may then be captured by pulling the abdominal brace upwards and around the infant and the other fastener on the abdominal brace may be attached to a fastener on the cylindrical pillow cover to secure the infant in place. The diaper strap secures the infant against wiggling downwardly to threaten strangulation by the abdominal brace.

DESCRIPTION OF THE PREFERRED EMBODIMENTS

Figure 1:
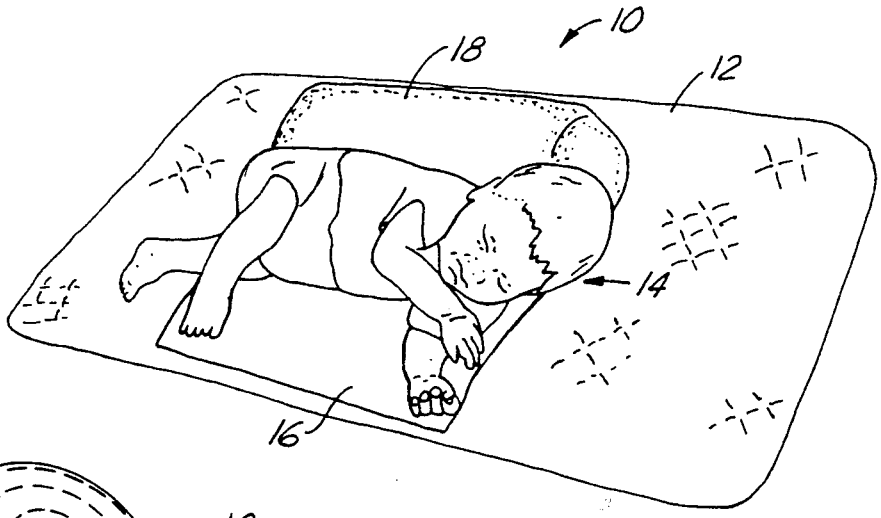
FIG. 1 is a perspective view of the infant sleep support with an infant in place.

Referring to FIGS. 1-4, the infant sleep support shown generally at 10 is placed on a mattress or other sleep platform 12 and an infant 14 is placed on the infant sleep support 10. More particularly, the infant is placed on its side so that the infant rests on a planar terry cloth sheet base 16. The infant 14 also rests his or her back against a cylindrical pillow 18, preferably also made of a terry cloth fabric.

Figure 2:
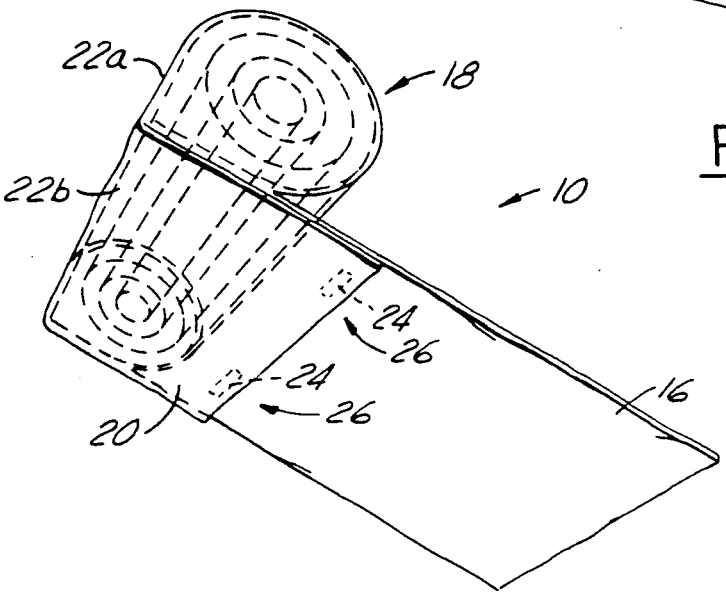
FIG. 2 is a perspective underside view of the infant sleep support.

As can be seen in FIG. 2, the planar sheet base 16 extends from the front of the cylindrical pillow 18, that is, the portion of the pillow 18 against which the infant 14 ( FIG. i ) has his or her back supported. Extending from the back of the pillow is a sheet flap 20, which extends underneath of the pillow in the direction of the sheet base 16.

Figure 3:
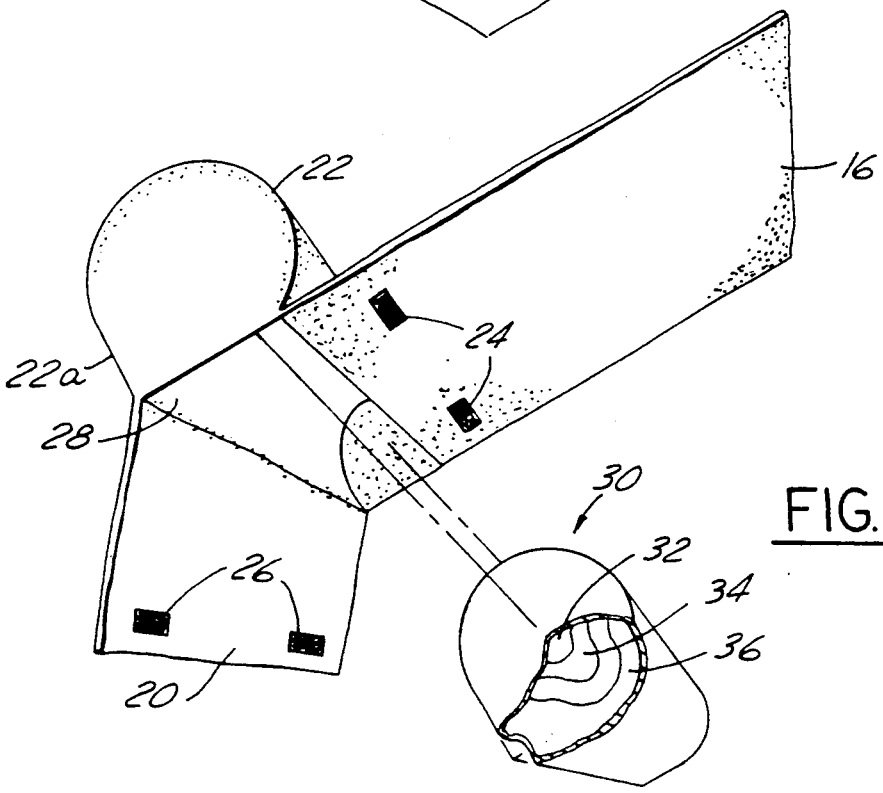
FIG. 3 is an exploded underside perspective view of the infant sleep support.

Referring now to FIG. 3, it can be understood that the pillow 18 comprises a pillow cover 22 to which the sheet base 16 and the sheet flap 20 are attached. The sheet base 16, the sheet flap 20, and the pillow cover 22 are all made of the same material, preferably a soft terry cloth material chosen for its comforting and caressing characteristics. The pillow cover 22 is constructed to provide a substantially cylindrical interior. Actually, the shape of the cover is such that it is substantially cylindrical as it extends around its axis from the front, which faces the infant 14, to the back. There, a generally a planar back **22*a* is tangent to the cylindrical shape. The planar tangent back 22*a* extends from its line of tangency to the cylinder shape downwardly to the sheet flap 20. This shape is provided so that the bottom of the pillow may be sustantially flat as it rests upon the mattress 12 (FIG. 1), and the base 22*b* (FIG. 2) of the planar back 22*a* provides leverage against the force of the infant 14 pushing against the pillow 18. As seen in the FIGURES planar back 22*a* and planar base 22*b*** are at generally right angles to each other.

Beneath the sheet base 16 are fasteners 24. Fasteners are preferably of the-hook-and-loop complementary fasteners of the type made by VELCRO TM brand. The fasteners beneath the sheet base 16 are either hook or loop. Complementary fasteners 26, either loop or hook, are disposed on the top side of sheet flap 20, relative to the orientation of the infant sleep support when in use, which mate with the fasteners 24 to attach the sheet flap 20 to the sheet base 16. With this attachment, the interior 28 of the pillow cover 22 is fully enclosed.

In the exploded view of FIG. 3, there is seen a pillow bolster 30 which is placed in the interior 28 of pillow cover 22 to form pillow 18. The bolster 30 is shaped as the cover and is constructed to be soft, yet supporting. One such construction might involve a center core 32 which is made of a cylinder of rigid material, such as wood or plastic. Surrounding the inner core are foam rubber 34 and/or other cotton or soft padding 36. The outer surface of bolster 30 is preferably vinyl or some other material impermeable to liquids. This latter preference is made to allow the bolster 30 to be wiped clean and dry should the infant 14 bring moisture to saturate and soil the infant sleep support 10.

Figure 4:
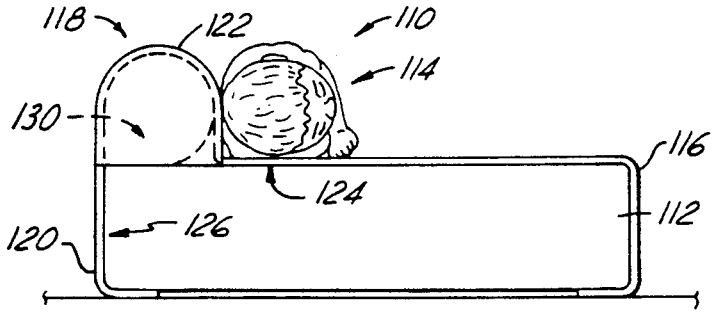
FIG. 4 is a side view of the infant sleep support with a baby in place.

FIG. 4 shows another embodiment of the invention in which an infant sleep support 110 has a pillow 118 against which an infant 114 supports its back. A sheet base 116 extends from the pillow 118 sufficiently to allow the sheet base 116 to be tucked under a mattress 112. Extending from the back of the pillow 118 is a sheet flap 120 which also extends to a sufficient length for tucking it under the mattress 112. Fasteners 124 may be placed on the underside of the sheet base 116 and fasteners 126 on the top side of the sheet flap 120 so that this embodiment may also be arranged to enclose fully the interior of the pillow cover 122 housing a bolster 130 in the manner of the earlier embodiment, should this be preferred instead of tucking the sheet base 116 and sheet flap 120 beneath the mattress 112.

Figure 5:
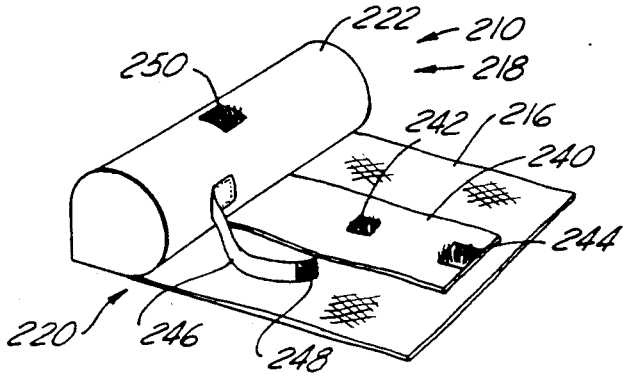
FIG. 5 is a perspective top view of the infant sleep support without a baby, showing another embodiment thereof.

Referring now to FIG. 5, yet another embodiment of the infant sleep support 210 is seen to have a pillow 218 and a sheet base 216. A sheet flap 220 extends beneath the sheet base 216 in the manner of the embodiment shown in FIG. 2. An additional element of an abdominal brace 240 is attached to the joinder of the pillow cover 222 and the sheet base 216. Attached to the upside of the abdominal brace, with respect to the orientation of the infant sleep support 210 as it is placed on the mattress, are fasteners 242 and 244, fastener 244 being disposed at an end portion of abdominal brace 240 and fastener 242 being disposed between fastener 244 and the joinder of the pillow cover 222 and the sheet base 216. Attached to the cylindrical front surface of the pillow cover 222 is a diaper strap 246. The diaper strap 246 extends from the cylindrical surface of the pillow cover 222 and at its free end portion is a fastener 248, which is complementary to the fastener 242. On the top side of the cylindrical surface of the pillow cover 222 is a fastener 250 which is complementary to fastener 244.

Figure 6:
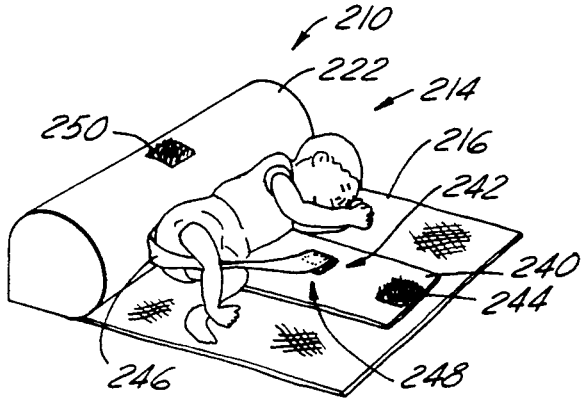
FIG. 6 and FIG. 7 are top perspective views of the embodiment shown in FIG. 5 with a baby in place.

Referring now to FIG. 6, there is seen an infant 214 resting upon the infant sleep support 210, and more particularly, on the sheet base 216 and the abdominal brace 240. The diaper strap 246 is threaded between the legs of the infant 214, and fastener 248 is attached to fastener 242.

Figure 7:
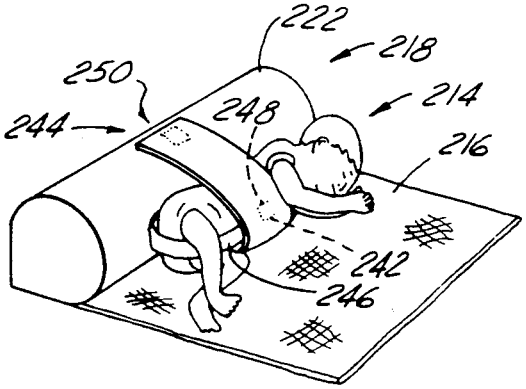

Referring now to FIG. 7, it is seen that the infant 214, placed as shown in FIG. 5, is captured by pulling the abdominal brace 246 upwards and around the infant 214 and attaching fastener 244 to fastener 250. The infant 214 is now secured in place. The diaper strap 246 secures the infant 214 against wiggling downwardly so as to endanger the infant by the abdominal brace 240.

Figure 8:
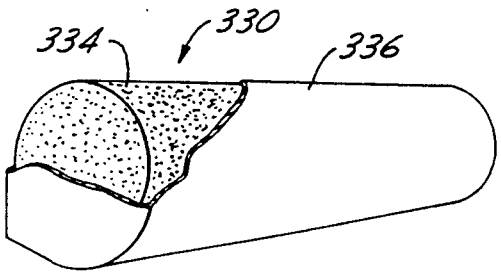
FIG. 8 is a perspective view of one element of the infant sleep support.

FIG. 8 shows an alternative design for the bolster 330. In this alternative design the outer cover 336 is still preferably made of a protective covering as a barrier against liquids. The inner core 334, however, is a single piece of foam.

Other embodiments of the infant sleep support are disclosed by including mechanisms such as an insulated heating mechanism within the bolster to warm the infant or a low level vibrator. Thus, the infant sleep support provides for comfort to the child as well as protection against the child rolling on its stomach or back, both of which consequences are taught by pediatricians to be better avoided. Furthermore, the infant sleep support may be used as a training device to train older children to sleep in a bed without protective sides.

Any embodiment of the invention that has been described in detail may be subjected to modifications and other embodiments incorporating the inventive features. Accordingly, it is intended that the foregoing disclosure is to be considered as illustrating the principals of the present invention as an example of those features and not as a delimiting description, which is the purpose of the claims that follow.

We claim:

1. An infant sleep support for supporting an infant while the infant sleeps, the infant sleep support comprising:

a planar fabric sheet having a topside and an underside, said sheet being of sufficient size for an infant to lay on the topside of said sheet substantially within the boundaries of said sheet;

a pillow cover attached to said sheet to form a juncture between said sheet and said pillow cover, said pillow cover for receiving a pillow therein, said pillow cover having an underside adjacent the underside of said sheet and said pillow cover including a closable opening means located on the underside of said pillow cover, permitting the removal and insertion of said pillow into the pillow covering; and encircling means for encircling generally the stomach area of the infant and holding the infant in a reclined position against the pillow, thereby maintaining the infant on its side during sleep.

2. The sleep support of claim 1, further comprising safety means for constraining the infant from sliding the infant's shoulders through said encircling means.

3. The sleep support of claim 1, wherein the encircling means is an abdominal brace attached to the juncture of the sheet and the pillow cover, the abdominal brace having a free end, and wherein at least one of said pillow cover and said free end of said abdominal brace has a first fastening means to attach said free end to said pillow cover when said abdominal brace is wrapped around generally the stomach area of said infant.

4. The sleep support of claim 2, wherein the safety means is a diaper strap attached to the pillow cover, the diaper strap having a free end and the diaper strap extending from the pillow cover to the free end of the diaper strap, said diaper strap for threading between the legs of the infant, and wherein at least one of said encircling means and said diaper strap has fastening means to fasten said diaper strap to said encircling means for preventing said infant from sliding its shoulders through said encircling means.

5. The sleep support of claim 3 further comprising diaper strap attached to the pillow cover, the diaper strap having a free end and the diaper strap extending from the pillow cover to the free end of the diaper strap, said diaper strap for threading between the legs of the infant, and wherein at least one of said abdominal brace and said diaper strap has a second fastening means to fasten said diaper strap to said abdominal brace for preventing said infant from sliding its shoulders through said abdominal brace.

6. The sleep support of claim 5, wherein all said fastening means are hook-and-loop type fasteners.

7. The sleep support of claim 1, further comprising said pillow.

8. An infant sleep support for supporting an infant while the infant sleeps, the infant sleep support comprising:

a planar fabric sheet having a topside and an underside, said sheet being of sufficient size for an infant to lay on the topside of said sheet substantially within the boundaries of said sheet;

a pillow cover attached to said sheet to form a juncture between said sheet and said pillow cover, said pillow cover for receiving a pillow therein, said pillow cover having an underside adjacent the underside of said sheet and said pillow cover including a closable opening means located on the underside of said pillow cover, permitting the removal and insertion of said pillow into the pillow cover;

an abdominal brace attached to the juncture of the sheet and the pillow cover, the abdominal brace having a free end, at least one of said pillow cover and said free end of said abdominal brace having a first fastening means to attach said free end to said pillow cover when said abdominal brace is wrapped around generally the stomach area of said infant; and a diaper strap attached to the pillow cover, the diaper strap having a free end and the diaper strap extending from the pillow cover to the free end of the diaper strap, said diaper strap for threading between the legs of the infant, at least one of said abdominal brace and said diaper strap having a second fastening means to fasten said diaper strap to said abdominal brace for preventing said infant from sliding its shoulders through said abdominal brace.

* * * * *